US009520678B2

(12) United States Patent
Su et al.

(10) Patent No.: US 9,520,678 B2
(45) Date of Patent: Dec. 13, 2016

(54) SIGNAL TRANSMISSION CONNECTOR

(71) Applicant: NEXTRONICS ENGINEERING CORP., New Taipei (TW)

(72) Inventors: Hou-An Su, Keelung (TW); Hung-Wei Hsu, Taipei (TW); Chang-Fa Yang, Taipei (TW); Huai-Sheng Wang, Taichung (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 14/948,391

(22) Filed: Nov. 23, 2015

(65) Prior Publication Data

US 2016/0079709 A1 Mar. 17, 2016

Related U.S. Application Data

(63) Continuation-in-part of application No. 14/158,810, filed on Jan. 18, 2014, now abandoned.

(51) Int. Cl.
*H01R 13/6477* (2011.01)
*H01R 12/72* (2011.01)
*H01R 13/506* (2006.01)

(52) U.S. Cl.
CPC ..... *H01R 13/6477* (2013.01); *H01R 12/721* (2013.01); *H01R 13/506* (2013.01)

(58) Field of Classification Search
CPC ..... H01R 13/6473; H01R 13/6461; H01R 13/6477; H01R 12/721; H01R 13/506
USPC ..... 439/676, 79, 80, 637, 933
See application file for complete search history.

(56) References Cited

U.S. PATENT DOCUMENTS

2005/0026474 A1* 2/2005 Li ..... H01R 12/724 439/79

* cited by examiner

*Primary Examiner* — Abdullah Riyami
*Assistant Examiner* — Nelson R Burgos-Guntin
(74) *Attorney, Agent, or Firm* — Li & Cai Intellectual Property (USA) Office

(57) ABSTRACT

A signal transmission connector includes an insulating body, a plurality of first terminals, a plurality of second terminals, and a rear casing. The insulating body has a dielectric constant of about 3 to 3.4. The first and second terminals are disposed on the insulating body. The first and second terminals have widths of about 0.36 to 0.42 mm. The rear casing is assembled at the second end of the insulating body. The rear casing envelops the first and the second terminals. The rear casing has a dielectric constant of about 3.5 to 3.8. The connector provides adjustable impedance without modifications to the terminal structures and also reduces cost.

3 Claims, 6 Drawing Sheets

SIGNAL TRANSMISSION CONNECTOR

CROSS-REFERENCE TO RELATED APPLICATIONS

This application is a Continuation-in-Part of application Ser. No. 14/158,810 filed Jan. 18, 2014, now pending, and entitled Signal Transmission Connector.

BACKGROUND OF THE INVENTION

1. Field of the Invention

The instant disclosure relates to a signal transmission connector; in particular, to a signal transmission connector for small form-factor pluggables (SFP).

2. Description of Related Art

Conventional transceiver modules typically apply to connect circuit board for communication lines and other electrical modules and equipment. Various industrial standards define computer and external communication equipment such as modems, network interfaces or other connector types having different transceiver module interfaces. Gigabit interface converter (GBIC) is a computer with Ethernet, fiber optic channels, or other data transceiver modules capable of data communication.

In order to improve port density between network devices (such as switches, cables, patch panels, wiring boxes, computer input/output ports, etc.), miniaturization of transceiver modules are often applied. Small form-factor pluggable (SFP) modules are suitable for such miniaturization. Specifically, the SFP module is only half the volume of the GFIC transceiver module, thus providing communication systems with higher density.

High-speed data transmission systems require connectors that can control impedance to maintain the necessary data transmission rate at which the electrical system needs. China patent publication no. CN 202159785U discloses a "differential coupling connector" having a pair of terminals adapted to provide differential signals. Ground terminal is disposed opposite to the differential pair. The main body of the differential pair is arranged such that the differential pair is closer to one another, and the gap of the main body is reduced between the differential pair such that crosstalk is reduced and data transmission is enhanced. If the gap between terminals of the differential coupling connector is modified, the terminal structures are also affected such that substantial modifications to the terminal moldings are required, and in turn costs are substantially increased.

To address the above issues, the inventor strives via associated experience and research to present the instant disclosure, which can effectively improve the limitation described above.

SUMMARY OF THE INVENTION

The object of the instant disclosure is to provide an adjustable impedance of the signal transmission connector terminal structure without modification thereof while providing simple structure, the easy of manufacturing, and cost reduction.

In order to achieve the aforementioned objects, according to an embodiment of the instant disclosure, a signal transmission connector includes: an insulating body having a first end and a second end opposite the first end, a plurality of first terminals, a plurality of second terminals and a rear casing. The first end and the second end have a plurality of sidewalls arranged therebetween. The insulating body has a docking slot and a plurality of terminal slots, the sidewalls cooperatively define the docking slot, the docking slot is in air communication with the first end, the terminal slots are arranged above and below the docking slot, and the insulating body has a dielectric constant substantially from 3 to 3.4. The plurality of first terminals is disposed in the insulating body, the first terminals are disposed in the terminal slots, each of the first terminals has an end extended in the docking slot of the insulating body, each of the first terminals has another end extended out of the insulating body, and each of the first terminals has a width substantially from 0.36 to 0.42 mm. The plurality of second terminals is disposed in the insulating body, the second terminals are disposed in the terminal slots, each of the second terminals has an end extended in the docking slot of the insulating body, each of the second terminals has another end extended out of the insulating body, and each of the second terminals has a width substantially from 0.36 to 0.42 mm. The rear casing is disposed on the second end of the insulating body, the rear casing is disposed on the first terminal and the second terminal, and the rear casing has a dielectric constant substantially from 3.5 to 3.8.

Preferably, the terminal slots extend to the first end and the second end, each terminal slot has a front portion in air communication with the first end, the front portions have tapered cross-sections, the first terminals and the second terminals are arranged in the front portions. Each terminal slot also has a rear portion in air communication with the second end, the rear portions have tapered cross-sections, the first terminals and the second terminals are arranged in the rear portions.

Preferably, the insulating body has a dielectric constant of 3.1, and the rear casing has a dielectric constant of 3.6.

Preferably, each of the first terminals and each of the second terminals have a width of about 0.38 mm.

The instant disclosure improves upon the following:

The most preferred widths of the first and the second terminals range from 0.36 to 0.42 mm, the dielectric constant of the insulating body ranges from 3 to 3.4, and the dielectric constant of the rear cover ranges from 3.5 to 3.8. The rear casing and the body have different dielectric constants. The rear casing can be the most preferably matched such that differential signal of the connector has the most preferred impedance, crosstalk is reduced, and in turn increases data transfer rate. Furthermore, the terminal structures of the instant disclosure need not vary to provide adjustable impedance. The terminals have simple structures, provide ease of manufacturing, and reduce production cost.

The front portions of the terminal slots have tapered cross-sections. The first terminals and the second terminals are disposed in and can be adjusted with respect to the front portions of the terminal slots in order to adjust impedance.

The rear portions of the terminal slots have tapered cross-sections. The first terminals and the second terminals are disposed in and can be adjusted with respect to the rear portions of the terminal slots in order to adjust impedance.

Impedance matching is maintained by adjusting the shape of the plastic slots, dielectric constants and the preferred terminal widths to modify corresponding inductance and capacitance, such that stability of signal transmission at the terminals is maintained. The pitch further emphasizes the control of impedance.

In order to further understand the instant disclosure, the following embodiments and illustrations are provided. However, the detailed description and drawings are merely illustrative of the disclosure, rather than limiting the scope being defined by the appended claims and equivalents thereof.

DETAILED DESCRIPTION OF THE PREFERRED EMBODIMENTS

Figure 1:
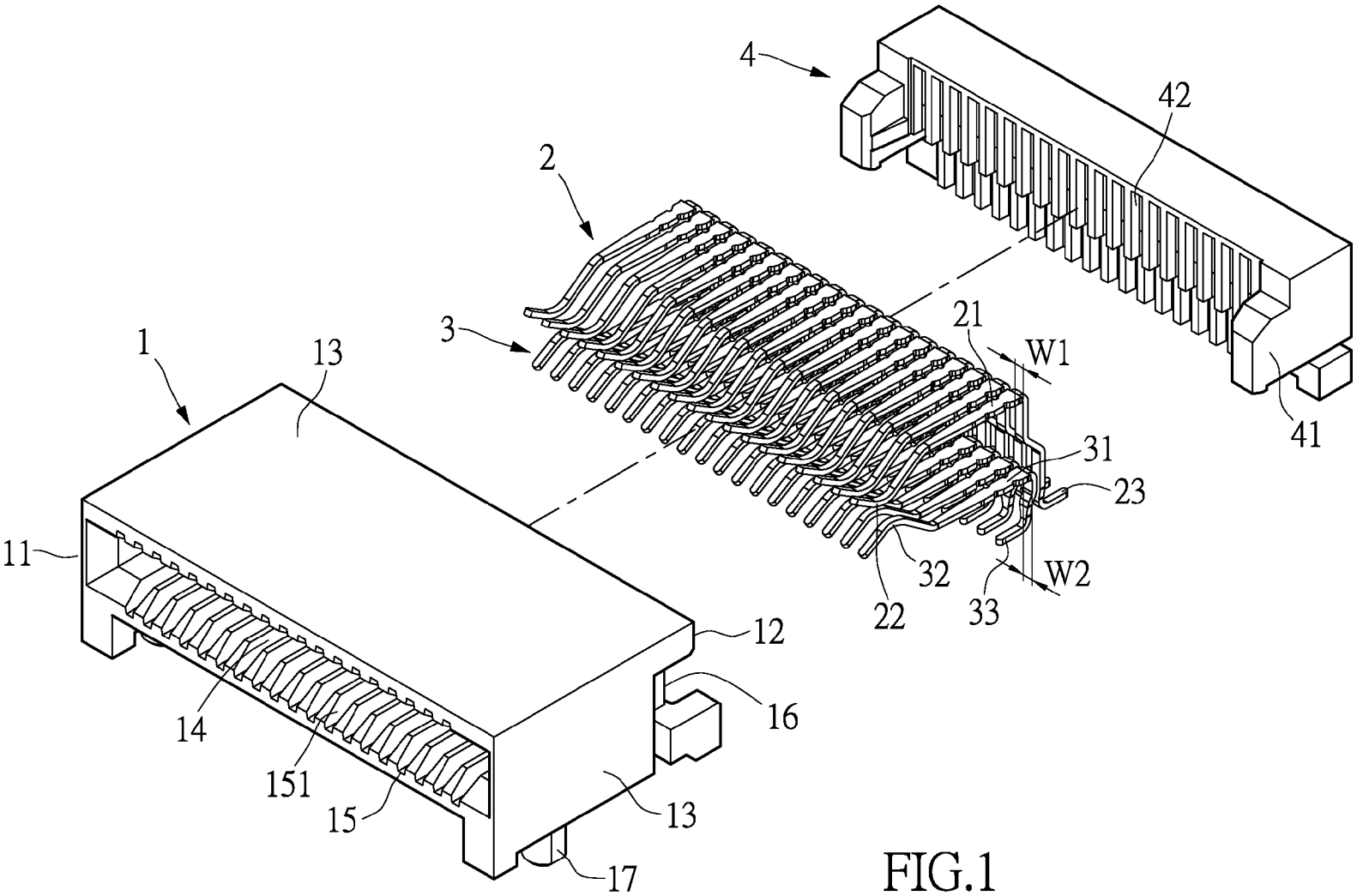
FIG. 1 is an exploded view of a signal transmission connector in accordance with the instant disclosure.
Figure 2:
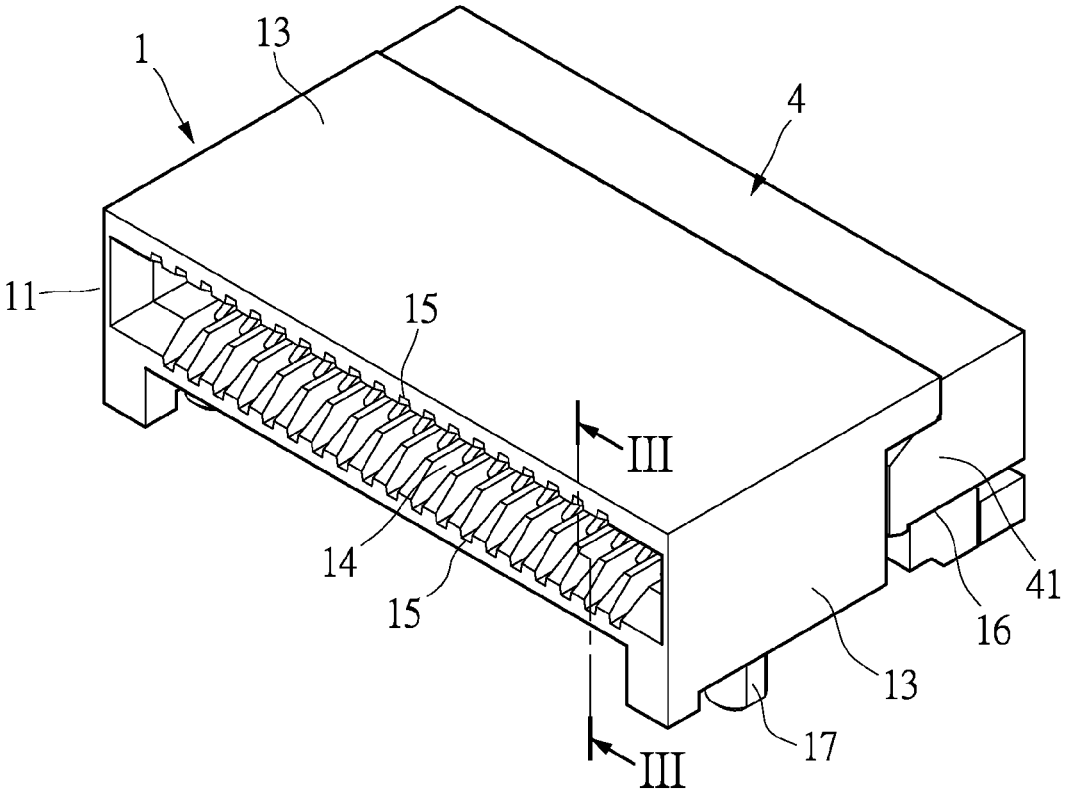
FIG. 2 is an assembled view of the signal transmission connector in accordance with the instant disclosure.
Figure 3:
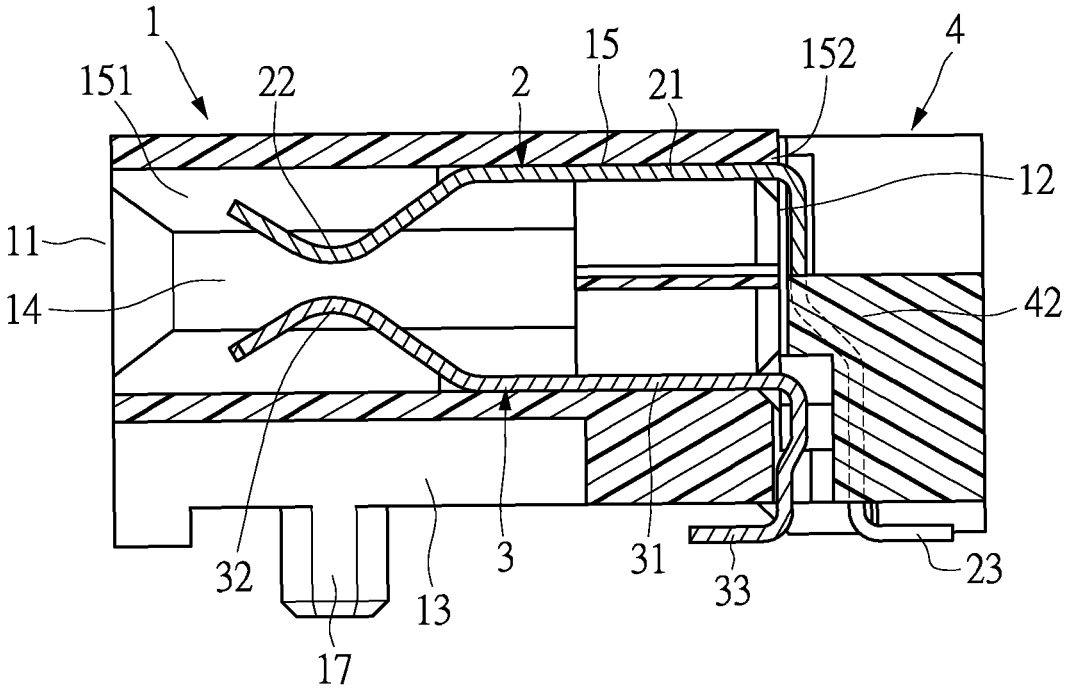
FIG. 3 is a cross-sectional view of the signal transmission connector in accordance with the instant disclosure.

Please refer to FIGS. 1 to 3. The instant disclosure provides a signal transmission connector, specifically, a small detachable module connector compatible with small form-factor pluggable standards. The signal transmission connector includes an insulating body 1 (the body 1), a plurality of first terminals 2, a plurality of second terminals 3, and a rear casing 4.

The body 1 is made of insulating materials (such as plastics). The body 1 has a first end 11 and the second end 12 opposite to the first end 11. The first end 11 and the second end 12 have four sidewalls 13 connected therebetween. The four sidewalls 13 are respectively defined as the top side, the bottom side, the left side, and the right side of the insulating body 1. Top, bottom, left, and right are terms serving only as reference orientations in the embodiments of the instant disclosure, but do not limit the scope of the instant disclosure to the orientation of the sidewalls provided by the examples herein. The insulating body 1 has a docking slot 14 and a plurality of terminal slots 15. The docking slot 14 is formed between the sidewalls 13. The docking slot 14 resembles substantially to the shape of a rectangle. The docking slot 14 is in air communication with the first end 11. The docking slot 14 can be mated to match connectors.

The terminal slots 15 are arranged at the two oppositely faced top side and bottom side of two sidewalls 13. In other words, the terminal slots 15 are arranged above and below the docking slot 14 for assembling with the first terminals 2 and the second terminals 3. The terminal slots 15 above the docking slot 14 can align with or offset from the terminal slots 15 below the docking slot 14. Portions of the terminal slots 15 above the docking slot 14 can align with or offset from portions of the terminal slots 15 below the docking slot 14. The terminal slots 15 above the docking slot 14 are offset from the terminal slots 15 below the docking slot 14 in the instant embodiment.

The terminal slots 15 can extend to the first end 11 and the second end 12. In other words, two ends of the terminal slots 15 can be formed through the first end 11 and the second end 12. Each of the terminal slots 15 has a front portion 151 and a rear portion 152. The front portion 151 is arranged in immediate proximity to the first end 11, and the rear portion 152 is arranged in immediate proximity to the second end 12. The body 1 can also have a pre-determined number of fixing post or posts 17 protruding from a bottom portion of the body 1 for docking to the corresponding fixing groove or grooves (not shown in the figures) of a circuit board such that the connector is securely fixed on the circuit board.

The first terminals 2 and the second terminals 3 are made of metallic materials or metal alloys having good or preferred electrical conductivity. The first and second terminals 2, 3 are compatible with small form-factor pluggable (SPF) standards. Each of the first and second terminals 2, 3 can respectively have a fixing portion 21, 31, a contact portion 22, 32, and a soldering portion 23, 33. In the instant embodiment, the fixing portions 21, 31 resemble horizontally arranged plates, the contact portions 22, 32 are bent to resemble elastic sheets, whereas the soldering portions 23, 33 resemble L-shaped plate bodies. Moreover, the contact portions 22, 32 are respectively connected to an end of the fixing portions 21, 31 whereas the soldering portions 23, 33 are respectively connected to the other end of the fixing portions 21, 31. The shapes of first terminals 2 and the second terminals 3 are not limited to the example provided herein and may vary according to preferences.

The first and second terminals 2, 3 are arranged on the insulating body 1. The first and second terminals 2, 3 can be inserted into the body 1 such that the first and second terminals 2, 3 are received in the terminal slots 15. The first and second terminals 2, 3 are arranged as two oppositely faced upper and lower rows, in which the second terminals 3 are arranged below the first terminals 2. The first terminals 2 and the second terminals 3 can be fixed to the insulating body 1 via the fixing portions 21, 31. The fixing portions 21, 31 are fixed to the body 1 via physical connection. One end of each of the first and second terminals 2, 3 (the contact portions 22, 32) extends into the docking slot 14 of the body 1, and can be in contact with a matching connector that is plugged into the docking slot 14 to establish electrical connection therebetween. The other end of each of the first and second terminals 2, 3 (the soldering portions 23, 33) extends out of the insulating body 1 for abutting or soldering to the circuit board such that the connector of the instant disclosure can be in electrical connection with the circuit board.

Figure 4:
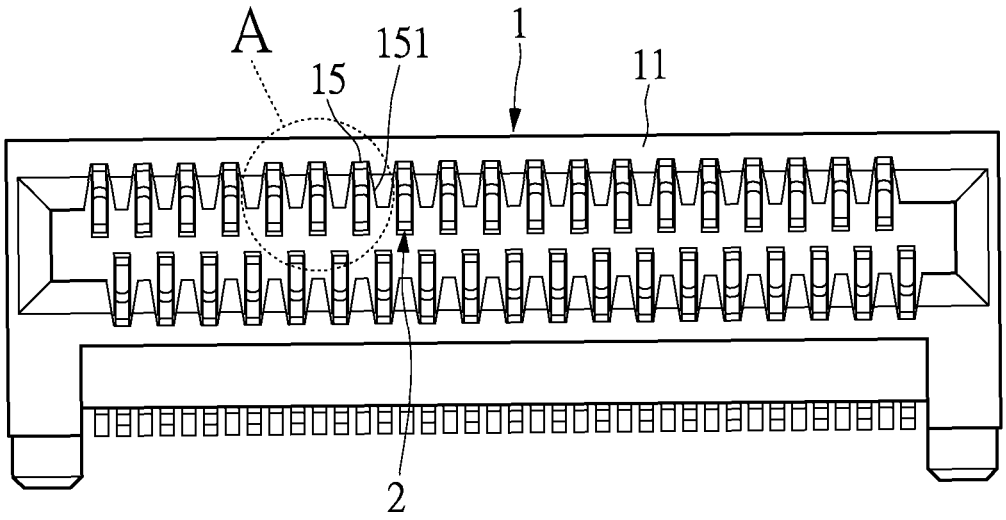
FIG. 4 is a front view of an insulating body in accordance with the instant disclosure.
Figure 4A:
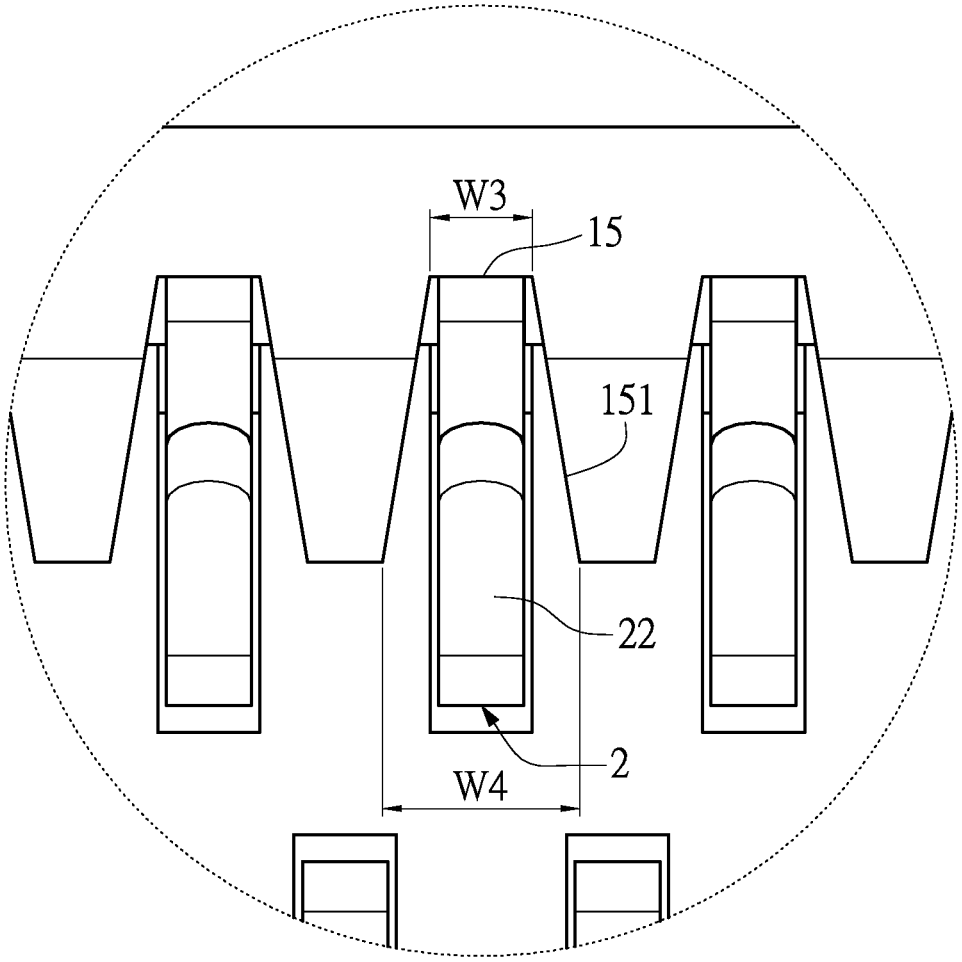
FIG. 4A is a close-up view of an insulating body of FIG. 4 in accordance with the instant disclosure.
Figure 5:
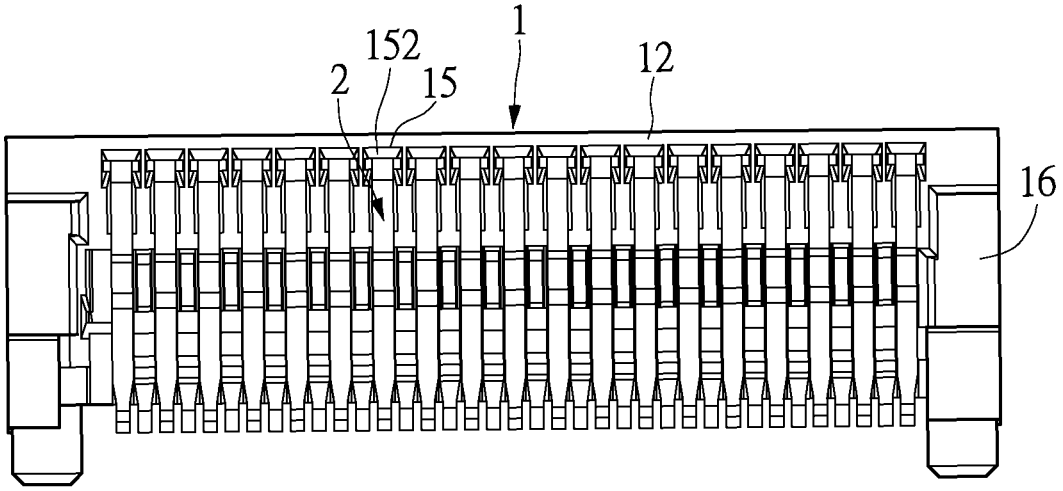
FIG. 5 is a rear view of an insulating body in accordance with the instant disclosure.

The front portions 151 and the rear portions 152 have tapered cross-sections (as shown in FIGS. 4 and 5). In other words, the front portions 151 and the rear portions 152 have different widths. Specifically, each front portion 151 has a width W3 at upper portion and a width W4 at lower portion thereof (as shown in FIG. 4A), and the width W3 at upper portion is different from the width W4 at lower portion thereof. Moreover, the width W3 at upper portion of each front portion 151 is substantially equal to the width of each contact portion 22, 32, whereas the width W4 at lower portion of each front portion 151 is greater than the width of each contact portion 22, 32, such that the air gaps (the dielectric constant of air is equal to 1) can be provided between each front portion 151 and each the contact portions 22, 32 for impedance matching. Similarly, the widths of the rear portions 152 at upper portions thereof are different from the widths of the rear portions 152 at lower portions thereof.

The first and second terminals 2, 3 are adjustable near the front portions 151 and rear portions 152 of the terminal slots 15 according to preferences. The tapered cross-sections of the front and rear portions 151, 152 can provide adjustments for the first and second terminals 2, 3 such that the first and second terminals 2, 3 can be guided into the contact area of the body 1. For example, the first and second terminals 2, 3 can be arranged distal to the front portions 151 of the terminal slots 15 to reduce the contact area between the first and second terminals 2, 3 and the insulating body 1, such that impedance increases. Alternatively, the first and second terminals 2, 3 can be arranged in close proximity with the front portions 151 of the terminal slots 15 to increase the contact area between the first and second terminals 2, 3 and the insulating body 1, such that impedance reduces. In turn, the connector can adjust specific impedance. The tapered cross-sectioned terminal slots 15 of the instant disclosure and vertically grooved terminal slots 15 can be made to adapt to the variance in capacitance and inductance of the widths of terminals 2, 3.

The first and second terminals 2, 3 respectively have widths W1, W2. The widths of the first and second terminals 2, 3 are about 0.36 to 0.42 mm, with 0.38 mm as the preferred width. In the instant embodiment, the widths W1, W2 of the first and second terminals 2, 3 are defined as the widths of the upright portion (such as in FIG. 1). The first and second terminals 2, 3 are arranged with a 0.8 mm gap therebetween. In other words, between every two first terminals 2 or two second terminals 3, there is a pitch of 0.8 mm.

The rear casing 4 is made of insulating materials (such as plastics). The length and height of the rear casing 4 substantially corresponds to that of the insulating body 1. The rear casing 4 and the body 1 are made of different materials and different grades of materials. In the instant embodiment, the insulating body 1 and the rear casing 4 are made of different grades of liquid crystal polyester (LCP), such that the body 1 and the rear casing 5 have different dielectric constant and can also increase the dielectric constant of the rear casing 4. The dielectric constant of the insulating body 1 ranges from 3 to 3.4 with a preferred constant at 3.1, whereas the dielectric constant of the rear casing 4 ranges from 3.5 to 3.8 with a preferred constant of 3.6. Moreover, the dielectric constant of the rear casing 4 is greater than the dielectric constant of the insulating body 1 for the most preferred impedance.

The rear casing 4 is assembled at the second end 12 of the body 1. The rear casing 4 can overlay the first and the second terminals 2, 3. In other words, the rear casing 4 can cover portions of the first and the second terminals 2, 3 protruding out of the insulating body 1, such that the first and the second terminals 2, 3 are substantially enveloped. The body 1 has two first coupling portions 16 arranged thereon. The first coupling portion 16 can be a coupling slot or a coupling protrusion. The rear casing 4 has two second coupling portions 41 arranged thereon. The second coupling portion 41 can be a coupling slot or a coupling protrusion. The first coupling portion 16 and the second coupling portion 41 are coupled to one another. For example, the rear casing 4 of the instant embodiment is coupled to the insulating body 1 via snapping, such that the rear casing 4 is assembled to the second end 12 of the body 1. The rear casing 4 can also be assembled to the body 1 by physical abutment or adhesives, but not limited to the examples provided herein. Moreover, the rear casing 4 has a plurality of receiving slots 42 arranged on a surface thereof proximate to the second end 12 of the body 1. The receiving slots 42 are spaced at predetermined intervals. The first terminals 2 can be received in the receiving slots 42.

The most preferred widths of the first and the second terminals 2, 3 range from 0.36 to 0.42 mm, the dielectric constant of the insulating body 1 ranges from 3 to 3.4, and the dielectric constant of the rear cover 4 ranges from 3.5 to 3.8. The rear casing 4 and the body 1 have different dielectric constants. Moreover, the dielectric constant of the rear casing 4 is greater than the dielectric constant of the insulating body 1 for the most preferred impedance. The rear casing 4 can be the most preferably matched such that differential signal of the connector has the most preferred impedance, crosstalk is reduced, and in turn data transmission rate increases. In the instant embodiment, time-domain reflectometer (TDR) is applied for testing suitable or the preferred impedance, 100±10Ω. Furthermore, the terminal structures of the instant disclosure need not vary to provide adjustable impedance. The terminals have simple structures, provide ease of manufacturing, and reduce production cost. Moreover, impedance matching is maintained by adjusting the shape of the plastic slots, dielectric constants and the preferred terminal widths to modify corresponding inductance and capacitance, such that signal transmission stability at the terminals is maintained. The pitch further emphasizes the control of impedance.

The figures and descriptions supra set forth illustrated the preferred embodiments of the instant disclosure; however, the characteristics of the instant disclosure are by no means restricted thereto. All changes, alternations, combinations or modifications conveniently considered by those skilled in the art are deemed to be encompassed within the scope of the instant disclosure delineated by the following claims.

What is claimed is:

1. A signal transmission connector, comprising:

an insulating body having a first end and a second end opposite the first end, the first end and the second end having a plurality of sidewalls arranged therebetween, the insulating body having a docking slot and a plurality of terminal slots, the sidewalls cooperatively defining the docking slot, the docking slot in air communication with the first end, the terminal slots arranged above and below the docking slot, and the insulating body having a dielectric constant substantially equal to 3.1;

a plurality of first terminals disposed on the insulating body, the first terminals arranged in the terminal slots, each of the first terminals having an end extended in the docking slot of the insulating body, each of the first terminals having another end extended out of the insulating body, each of the first terminals having a width substantially equal to 0.38 mm;

a plurality of second terminals disposed on the insulating body, the second terminals arranged in the terminal slots, each of the second terminals having an end extended in the docking slot of the insulating body, each of the second terminals having another end extended out of the insulating body, each of the second terminals having a width substantially equal to 0.38 mm; and a rear casing disposed at the second end of the insulating body, the rear casing disposed on the first terminal and the second terminal, the rear casing having a dielectric constant substantially equal to 3.6, and the dielectric constant of the rear casing is greater than the dielectric constant of the insulating body;

wherein the terminal slots extend to the first end and the second end, each terminal slot has a front portion in air communication with the first end, the front portions have tapered cross-sections, each of the first terminals and the second terminals respectively has a contact portion arranged in each front portion;

wherein each front portion having a width at upper portion and a width at lower portion thereof, and the width at upper portion is different from the width at lower portion thereof;

wherein the width at upper portion of each front portion is substantially equal to a width of each contact portion, whereas the width at lower portion of each front portion is greater than the width of each contact portion;

wherein the insulating body has two coupling slots arranged thereon, the rear casing has two coupling protrusions arranged thereon, and the two coupling slots are correspondingly mated to the two coupling protrusions;

wherein the rear casing has a plurality of receiving slots arranged on a surface of the rear casing oriented toward the second end of the insulating body, and the first terminals are arranged in the receiving slot;

wherein the width of each first terminal, the width of each second terminal, the dielectric constant of the insulating body, and the dielectric constant of the rear casing are configured so as to provide a predetermined matched impedance to maintain stability of signal transmission at the first and the second terminals.

2. The signal transmission connector as recited in claim 1, wherein each terminal slot has a rear portion in air communication with the second end, the rear portions having tapered cross-sections, the first terminals and the second terminals respectively has a fixing portion arranged in each rear portion, and each contact portion is connected to an end of each fixing portion.

3. The signal transmission connector as recited in claim 1, wherein the first terminals and the second terminals are arranged apart by a gap of about 0.8 mm.

* * * * *